United States Patent [19]

Corey

[11] Patent Number: 5,059,051

[45] Date of Patent: Oct. 22, 1991

[54] FASTENER DEVICE

[75] Inventor: Joseph T. Corey, Eggertsville, N.Y.

[73] Assignee: Permclip Products Corporation, Buffalo, N.Y.

[21] Appl. No.: 626,427

[22] Filed: Dec. 17, 1990

Related U.S. Application Data

[63] Continuation of Ser. No. 276,872, Nov. 28, 1988, abandoned.

[51] Int. Cl.[5] ..... B42F 13/00

[52] U.S. Cl. ..... 402/75; 402/80 R

[58] Field of Search ..... 402/8, 13, 73, 75, 70, 402/80 R, 14

[56] References Cited

U.S. PATENT DOCUMENTS

| | | | |
|---|---|---|---|
| 3,867,743 | 2/1975 | Corey | 402/14 |
| 4,285,104 | 8/1981 | Corey et al. | 402/73 |

FOREIGN PATENT DOCUMENTS

| | | | |
|---|---|---|---|
| 629131 | 4/1936 | Fed. Rep. of Germany | 402/70 |
| 1133340 | 7/1962 | Fed. Rep. of Germany | 402/14 |
| 1297077 | 6/1969 | Fed. Rep. of Germany | 402/14 |
| 113110 | 8/1940 | New Zealand | 402/14 |
| 561608 | 5/1975 | Switzerland | 402/8 |

*Primary Examiner*—Paul A. Bell

*Attorney, Agent, or Firm*—Joseph P. Gastel

[57] ABSTRACT

A fastener device including an overlay member having a central portion and opposite end portions, spaced apertures at the junctions of the central portion and the opposite end portions, an elongated strip-like prong member having a central portion underlying the central portion of the overlay member and having opposite end portions extending through the apertures and overlying the opposite end portions of the overlay member, the prong member having rounded side edges throughout the major portion of its length, and extreme outer end portions having converging sides which are sharpened. A fastener device of the above type wherein the apertures in the overlay member are quadrangular. A prong member having rounded side edges throughout the major portion of its length and sharp converging extreme outer end portions.

15 Claims, 1 Drawing Sheet

Fig. 1.
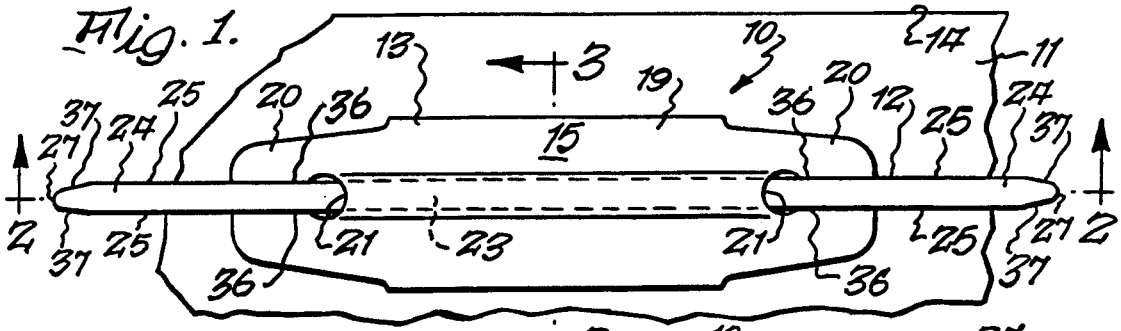
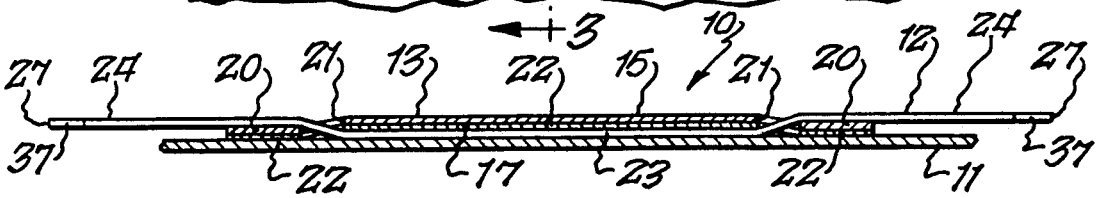
Fig. 2.
Fig. 3.
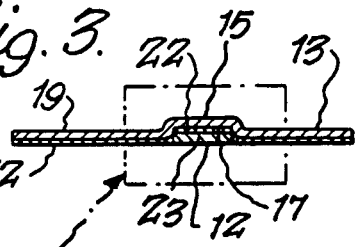
Fig. 4
Fig. 4.
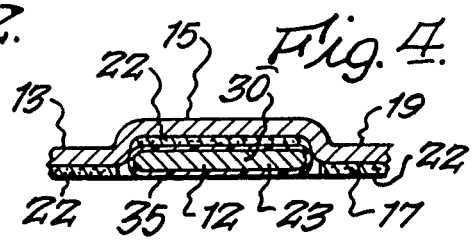
Fig. 10.
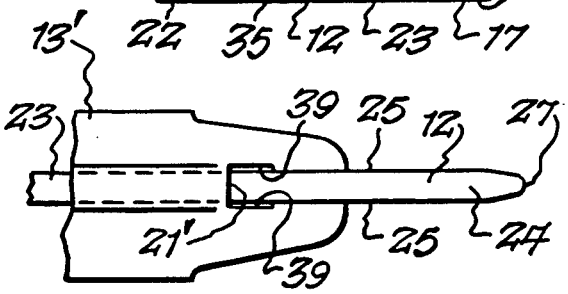
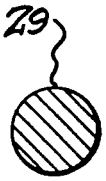
Fig. 5.
Fig. 6.
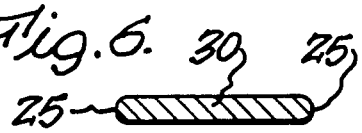
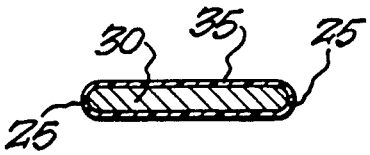
Fig. 7.
Fig. 7A.
PRIOR ART
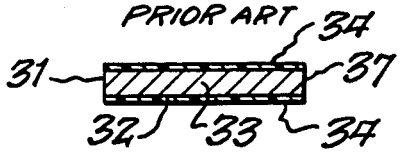
Fig. 9.
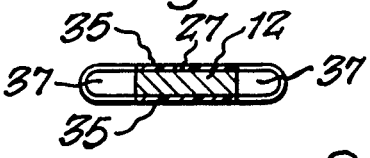
Fig. 8.
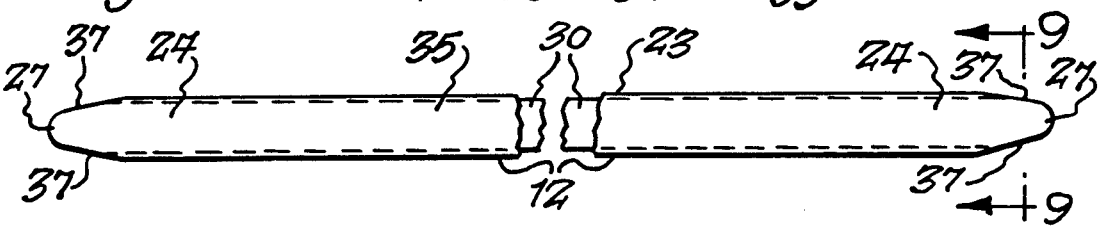

FASTENER DEVICE

This application is a continuation of application Ser. No. 276,872, filed Nov. 28, 1988 now abandoned.

BACKGROUND OF THE INVENTION

The present invention relates to fastener devices for holding papers for the like on a backing member and more particularly relates to an improvement in a fastener device of the type disclosed in U.S. Pat. No. 3,867,743.

By way of background, there is a type of fastener device known in the art which includes an overlay member which secures a metal prong member to a file folder. The prong member includes a central portion which is held against the backing member by the overlay member. Two outer end portions of the prong member extend outwardly from the overlay member for receiving papers and holding such papers in position on the backing member after the outer end portions have been bent downwardly. In the past the side edges of the outer end portions were sharp and thus had certain disadvantages, namely, they could tear papers placed thereon, they were subject to corrosion or rusting, and they could cut fingers of the people who were manipulating them.

In addition to the foregoing, fasteners of the above described general type usually had spaced circular holes therein through which the opposite end portions of the prong member protruded. However, the sharp side edge portions of the prong members could contact the sides of the aperture and thus tear or mutilate it. Furthermore, assembling the prong members through the round apertures required precision operation.

SUMMARY OF THE INVENTION

It is accordingly one object of the present invention to provide an improved fastener device having a metal prong member, the outer edge portions of which are rounded and coated with plastic, and thus the prong member does not have the above enumerated deficiencies.

Another object of the present invention is to provide an improved fastener device of the above type wherein only the extreme outer end portions of the prong members are sharpened to thereby facilitate their insertion through associated papers, with the sharpened extreme outer end portions being a sufficiently small part of the prong outer end portions so that the entire prong member does not have the above-enumerated deficiencies.

A further object of the present invention is to provide an improved fastener device of the above type having apertures therein through which the prong member extends, the apertures having side edge portions which are spaced sufficiently from the side edges of the prong member so that there cannot be any contact therebetween, which, in turn, obviates the tendency for mutilation or tearing of the edges of the apertures by the prong member.

Still another object of the present invention is to provide an improved prong member which has rounded side edges which are not sharp and which do not have an exposed metal surface. Other objects and attendant advantages of the present invention will readily be perceived hereafter.

The present invention relates to a unitary assembled fastener device adapted to be adhesively secured to a backing member comprising an overlay member of sheet material having an overlay central portion and overlay opposite end portions and an overlay upper surface and an overlay undersurface, an elongated strip-like prong member having a prong upper surface and a prong undersurface and a prong central portion and opposite prong end portions, rounded side edges on said prong central portion and said opposite prong end portions, bonding means for securing said prong upper surface of said prong central portion in contiguous relationship to said overlay undersurface with said prong end portions extending beyond said overlay central portion and with said prong end portions being exposed, and adhesive means on said overlay undersurface for securing said overlay member to said backing member.

The present invention also relates to a unitary assembled fastener device adapted to be adhesively secured to a backing member comprising an overlay member of sheet material having an upper overlay surface and an overlay undersurface and a central overlay portion and opposite overlay end portions, apertures having aperture side edges at the junctions of said central overlay portions and said opposite overlay end portions, a strip-like prong member having an upper prong surface and a prong undersurface and a central prong portion and opposite outer prong end portions and opposite substantially parallel prong side edges, said upper prong surface of said central prong portion being located in contiguous relationship to said overlay undersurface of said overlay central portion and said prong outer end portions extending through said apertures with their prong undersurfaces being located in overlying contiguous relationship to said upper surfaces of said overlay outer end portions and with said substantially parallel prong side edges within said aperture side edges and being spaced therefrom so that said prong side edges cannot contact said aperture side edges when said outer end portions of said prong members are bent upwardly.

The present invention also relates to a prong member for assembling with an overlay member comprising an elongated thin strip-like member having a greater length than width and a central portion and opposite end portions, and rounded side edges on said central portion and said opposite end portions.

The various aspects of the present invention will be more fully understood when the following portions of the specification are read in conjunction with the accompanying drawings wherein:

BRIEF DESCRIPTION OF THE DRAWINGS

FIG. 1 is a plan view of the pronged fastener containing an improved prong structure, said fastener being shown mounted on a fragmentarily-depicted backing member;

FIG. 2 is a cross sectional view taken substantially along line 2—2 of FIG. 1;

FIG. 3 is a cross sectional view taken substantially along line 3—3 of FIG. 1;

FIG. 4 is an enlarged fragmentary view of the area of FIG. 3 which is designated FIG. 4;

FIG. 5 is a cross sectional view of round wire stock which is subsequently formed into a flat prong member;

FIG. 6 is a cross sectional view of flattened stock after it has been formed from the round wire of FIG. 5;

FIG. 7 is a cross sectional view of the flattened stock of FIG. 6 after it has been coated with plastic;

FIG. 7A is a cross sectional view similar to FIG. 7 but showing a prior art construction;

FIG. 8 is a fragmentary plan view, partially broken away, showing the pronged member which has been stamped from an indeterminate length of the flattened stock of FIG. 7 after it has been coated with plastic;

FIG. 9 is a cross sectional view taken substantially along line 9—9 of FIG. 8; and FIG. 10 is a fragmentary plan view showing a modified embodiment of the present invention wherein the overlay member has square holes in its opposite ends rather than the round holes of FIG. 1.

DESCRIPTION OF THE PREFERRED EMBODIMENTS

The improved fastener device 10 is an improvement over that shown in U.S. Pat. No. 3,867,743. In FIGS. 1 and 2 fastener device 10 is shown mounted on backing member 11 which may be a conventional file folder or the like which has a rear leaf and a front leaf which overlies the rear leaf when the folder is closed. A folder of this type is fragmentarily shown in FIG. 1 of the above-mentioned patent. It will be understood, however, that fastener device 10 is readily adaptable for use with any backing member to which papers or the like are to be attached in stacked relationship.

Fastener device 10 includes an elongated strip-like prong member 12 and an elongated overlay member 13 which serves to maintain prong member 12 fixed on backing member 11, such as adjacent to the upper marginal edge 14 of backing member 11.

Overlay member 13 includes an upper surface 15 and an undersurface 17. It also includes a central portion 19 and opposite end portions 20 which lie outwardly of apertures 21. The outer end portions 20 have peripheries which are of the configuration shown in FIG. 1. Overlay member 13 may be formed from any suitable material, such as a paper stock, plastic, fabric, or a combination of the foregoing. A layer of adhesive 22 (FIG. 4) is located on undersurface 17. The adhesive 22 may be of any suitable type, such as pressure-sensitive adhesive or hot melt adhesive or any other type of adhesive.

Strip-like prong member 12 includes an upper surface and an undersurface. It also includes a prong central portion 23 which underlies central portion 15 of overlay member 13. It also includes prong outer end portions which extend outwardly from apertures 21. The parts of outer end portions 24 which are immediately adjacent to apertures 21 overlie the upper surface of overlay outer end portions 20.

Prong member 12 is fabricated from soft bendable metal so that when the overlay member 13 is fastened to backing member 11, the prong outer end portions 24 may be bent upwardly out of the plane of the drawing so that they can be inserted through holes in papers and thereafter bent down to a flattened condition to retain such papers on backing member 11.

In the past prong member 12 was fabricated from a plastic coated strip of metal which had die-cut edges throughout its length. Thus, the exposed metal outer edge portions 31 of the prior art prong member of FIG. 7A were sharp, and this was objectionable because they could cut the fingers of a person placing papers thereon and they could tear the paper which was being placed thereon and they could corrode or rust. In the latter respect, the edges 31 were exposed metal, notwithstanding that the upper and lower surfaces of the prong members were coated with plastic 34. The prior art strips were fabricated by die-cutting sheet metal material which was previously plastic-coated.

In accordance with the present invention, the side edges 25 of the entire prong member 12 are rounded, except for the extreme outer end portions 27. This is achieved by forming prong members 12 from round wire stock. More particularly, a round wire 29 (FIG. 5) is the starting point of the process of fabricating each prong member 12. The round wire 29 is obtained in rolls of indeterminate length and through a series of rolling operations is reduced to the cross sectional shape 30 of FIG. 6 whereby the outer edge portions 25 are rounded. After the elongated member 30 of indeterminate length is formed by rolling, it is painted with a very thin layer of a suitable plastic coating 35. Thereafter, the indeterminate length of rolled coated stock is cut into lengths with each length being a prong member 12 as shown in the drawings. When the cutting takes place, the extreme outer end portions 27 are formed with converging edges 37 for facilitating the entry of the outer end portions 24 into the holes of paper sheets which are to be mounted on them. However, the extreme outer edge portions 37 are necessarily sharpened as a result of the cutting process. The sharpened edges 37 comprise only a very small percentage of the exposed prong outer end portions 24 and thus contribute very little toward the possibiiity of cutting the fingers of the people who manipulate the prong members. Furthermore, the sharpened extreme outer edges 27 do contribute beneficially in penetrating papers which have undersized holes or papers which do not have any holes at all. Thus, the outer end portions 24 of prong member 12 have sharpened edges 37 where needed but the major portions are rounded to eliminate the disadvantages of prior art prong members. In the foregoing respect, a prior art prong member 32 is shown in FIG. 7A wherein the metal 33 is coated with plastic 34 on its opposite sides and wherein the opposite side edge portions 31 are sharp as a result of the die-cutting operations used in its fabrication.

As noted in the above U.S. Pat. No. 3,867,743, which is incorporated herein by reference, fastener 10 may be assembled by bowing overlay member 13 and passing prong member 12 along a straight line path lengthwise of member 13 through apertures 21. After prong member 12 is in proper alignment with overlay member 13, suitable heat and pressure are applied to the central portion 15 of overlay member 13 which overlies the central portion 23 of prong member 12 to thereby bond the two together when hot melt adhesive is the coating 22. However, this is not necessary if the coating is pressure sensitive adhesive.

In FIG. 10 an alternate embodiment of the present invention is disclosed. In this embodiment prong member 12 is identical in all respects to the prong member described above. However, overlay member 13' differs from overlay member 13 in that the two spaced apertures 21' are quadrangular rather than round, as depicted at 21 in FIG. 1. Apertures 21' are preferably square but they may be rectangular. The advantage of quadrangular holes in a fastener of the above type is manifold. In this respect, the assembly process, as described above, is simpler because the prong member 12 can enter rectangular holes easier than round holes because the sides 39 of holes 21' are parallel to the side edges of the prong member. In addition, the side edges 39 are not as susceptible to tearing when the outer end portions 24 of the prong member 12 are bent upwardly, because the side edges 25 of prong member 12 do not contact side edges 39 of aperture 21'. In contrast to this, as can be visualized from FIG. 1, when pronged end portions 24 are bent upwardly out of the plane of the drawing, the side edges 36 may bear against the edges of apertures 21 and thus either tear or mutilate them. However, it is to be noted that such tearing or mutilation of round apertures 21 is less likely with prong members 12 of the present invention which have round coated edges 25 than with the prior art prong members of FIG. 7A which have sharp edges adjacent the peripheries of apertures 21.

While the prong member has been described above in conjunction with an overlay member to which it is bonded, it will be appreciated that the prong member of the present invention can also exist as a separate article of commerce.

While preferred embodiments of the present invention have been disclosed, it will be appreciated that it is not limited thereto but may be otherwise embodied within the scope of the following claims.

What is claimed is:

1. A unitary assembled fastener device adapted to be adhesively secured to a backing member comprising an overlay member of sheet material having an overlay central portion and overlay opposite end portions and an overlay upper surface and an overlay undersurface, an elongated strip-like prong member having a prong upper surface and a prong undersurface and a prong central portion and opposite prong end portions, said prong member being fabricated of metal wherein the metal itself has rounded side edges on both said prong central portion and on said opposite prong end portions, bonding means for securing said prong central portion in contiguous relationship to said overlay undersurface with said prong end portions extending beyond said overlay central portion and with said prong end portions being exposed, and adhesive means on said overlay undersurface for securing said overlay member to the backing member.

2. A unitary assembled fastener device as set forth in claim 1 including spaced apertures in said overlay member at opposite ends of said overlay central portion at the junctions thereof with said overlay end portions, said prong end portions extending through said spaced apertures with the immediately adjacent prong undersurfaces of said prong end portions overlying said overlay end portions.

3. A unitary assembled fastener device as set forth in claim 2 wherein said apertures are round.

4. A unitary assembled fastener device as set forth in claim 1 wherein said prong outer end portions include extreme outer side edges which converge toward each other in a direction away from said prong central portion.

5. A unitary assembled fastener device as set forth in claim 4 wherein only said extreme outer side edges are sharpened and merge into said rounded side edge portions on parts of said opposite prong end portions.

6. A unitary assembled fastener device as set forth in claim 1 including a plastic coating on said metal strip-like member including said rounded edges of said metal strip-like member, said plastic coating on said rounded edges of said metal strip-like member being of substantially uniform thickness and also being rounded, and said plastic coating being thinner than said metal strip-like member.

7. A unitary assembled fastener device as set forth in claim 6 including extreme outer ends on said opposite prong end portions, and converging cut sides on sid extreme outer ends which do not have said thin plastic coating thereon.

8. A unitary assembled fastener device adapted to be adhesively secured to a backing member comprising an overlay member of sheet material having an upper overlay surface and an overlay undersurface and a central overlay portion and opposite overlay end portions, apertures defined by borders including substantially parallel side edges at the junctions of said central overlay portions and said opposite overlay end portions, a strip-like prong member having an upper prong surface and a prong undersurface and a central prong portion and opposite outer prong end portions and opposite substantially parallel prong side edges, said upper prong surface of said central prong portion being located in contiguous relationship to said undersurface of said overlay central portion and said prong outer end portions extending through said apertures with their prong undersurfaces being located in overlying contiguous relationship to said upper surfaces of said overlay outer end portions and with said substantially parallel prong side edges lying within and substantially parallel to said substantially parallel side edges of said apertures so that when said portions of said prong outer end portions are bent upwardly away from said overlay end portions, said opposite substantially parallel prong side edges do not cut across said substantially parallel side edges of said borders of said apertures.

9. A unitary assembled fastener device as set forth in claim 8 wherein said apertures are substantially quadrangular.

10. A unitary assembled fastener device adapted to be adhesively secured to a backing member comprising an overlay member of sheet material having an upper overlay surface and an overlay undersurface and a central overlay portion and opposite overlay end portions, apertures having aperture side edges at the junctions of said central overlay portions and said opposite overlay end portions, a strip-like prong member having an upper prong surface and a prong undersurface and a central prong portion and opposite outer prong end portions and opposite substantially parallel prong side edges, said upper prong surface of said central prong portion being located in contiguous relationship to said overlay undersurface of said overlay central portion and said prong outer end portions extending through said apertures with their prong undersurfaces being located in overlying contiguous relationship to said upper surfaces of said overlay outer end portions and with said substantially parallel prong side edges within said aperture side edges and being spaced therefrom so that said prong side edges cannot contact said aperture side edges when said outer end portions of said prong members are bent upwardly.

11. A prong member for assembling with an overlay member comprising an elongated thin strip-like member having a greater length than width and a central portion and opposite end portions, and said strip-like member being fabricated of metal wherein the metal itself has rounded side edges on said central portion and said opposite end portions.

12. A prong member as set forth in claim 11 including a plastic coating on said metal strip-like member including said rounded edges of said metal strip-like member, said plastic coating on said rounded edges of said metal strip-like member also being rounded and said plastic coating being thinner than said metal strip-like member.

13. A prong member as set forth in claim 11 including extreme outer edge portions at the outer ends of said outer end portions, said extreme outer end portions including extreme outer side edge portions which converge toward each other in a direction away from said central portion, said extreme outer side edge portions being die cut.

14. A prong member as set forth in claim 13 including a plastic coating on said metal strip-like member, said plastic coating being present on said rounded side edges and also being rounded thereon, said plastic coating being thinner than said metal strip-like member, and said plastic coating being absent from said extreme outer side edge portions.

15. A unitary assembled fastener device adapted to be adhesively secured to a backing member comprising an overlay member of sheet material having an overlay central portion and overlay opposite end portions and an overlay upper surface and an overlay undersurface, an elongated strip-like prong member having a prong upper surface and a prong undersurface and a prong central portion and opposite prong end portions, rounded side edges on said prong central portion and said opposite prong end portions, bonding means for securing said prong central portion in contiguous relationship to said overlay undersurface with said prong end portions extending beyond said overlay central portion and with said prong end portions being exposed, adhesive means on said overlay undersurface for securing said overlay member to the backing member, and quadrangular spaced apertures in said overlay member at opposite ends of said overlay central portion at the junctions thereof with said overlay end portions, said prong end portions extending through said spaced apertures with the immediately adjacent prong undersurfaces of said prong end portions overlying said overlay end portions.

* * * * *